US005517911A

United States Patent [19]

Rendell et al.

[11] Patent Number: 5,517,911

[45] Date of Patent: May 21, 1996

[54] PRINTING DEVICE

[75] Inventors: Michael Rendell, Dorking; David Rayner, Newbury, both of England

[73] Assignee: Komori Currency Technology U.K. Ltd., England

[21] Appl. No.: 223,708

[22] Filed: Apr. 4, 1994

[30] Foreign Application Priority Data

Apr. 6, 1993 [GB] United Kingdom ..... 9307182

[51] Int. Cl.[6] ..... B41J 1/60

[52] U.S. Cl. ..... 101/72; 101/110; 400/74

[58] Field of Search ..... 101/72, 73, 74, 101/91, 92, 109, 110; 428/901; 361/683, 748, 735; 400/74

[56] References Cited

U.S. PATENT DOCUMENTS

| | | | |
|---|---|---|---|
| 3,377,948 | 4/1968 | Giori . | |
| 3,569,982 | 3/1971 | Shebannon | 101/DIG. 30 |
| 4,068,578 | 1/1978 | Delligatti | 101/72 |
| 4,072,100 | 2/1978 | Polo | 101/72 |
| 4,283,755 | 8/1981 | Tracy | 361/393 |
| 4,494,109 | 1/1985 | Bernin | 400/479.2 |
| 4,743,821 | 5/1988 | Hall | 101/93 |
| 4,942,394 | 7/1990 | Gasiunas | 101/110 |
| 5,330,292 | 7/1994 | Sakanishi et al. | 405/141 |
| 5,455,385 | 10/1995 | Newton et al. | 361/735 |

FOREIGN PATENT DOCUMENTS

| | | |
|---|---|---|
| 2320187 | 3/1977 | France . |
| 2522574 | 1/1976 | Germany . |
| 3618488 | 7/1987 | Germany . |
| 1505940 | 4/1978 | United Kingdom . |
| 2243580 | 11/1991 | United Kingdom . |

*Primary Examiner*—John S. Hilten
*Attorney, Agent, or Firm*—Dilworth & Barrese

[57] ABSTRACT

A numbering box for a press for printing bank notes has a stack of sensor boards in one-to-one correspondence with a stack of numbering wheels and each of the boards has an edge area at the printing face of the numbering box which carries an LED indicator of a status of magnetic signalling means on the respective numbering wheel. The boards are each connected to a motherboard in the numbering box. Data processing means in the numbering box may be connected to a remote computer by an optical fibre link. The sensor boards are closely spaced and each has an aperture to accommodate a bulky component of the or an adjacent board.

13 Claims, 2 Drawing Sheets

PRINTING DEVICE

This invention relates to a device for printing a distinctive and different index code on each successive one of a succession of documents. The device is useful in the printing of documents such as banknotes. It may also be useful for printing serial numbers on product labels and tickets.

In security printing, successive value documents such as bank notes have to be printed with an individual serial number which uniquely identifies the particular printed document. This purpose is frequently served by numbering boxes which feature a coaxial stack of numbering wheels, each of these wheels having around its circumference a plurality of printing indicia which may be numbers or letters. At least one of the wheels is moved between the operation of printing each successive document, so that each document has its unique combination of printed indicia. Often, each bank note carries two impressions of the same unique serial number. Bank note printing presses are particularly large and complex presses. They may contain as many as 120 such numbering boxes. British Patent GB 2243580 A includes a description of such numbering boxes. In the present specification, the expression "numbering box" should be understood to include any module for printing indicia (whether numbers, letters or other signs) and printing elements which are not necessarily in the form of numbering wheels.

If there is a malfunction in one or other of the numbering boxes, leading to the printing of documents with an incorrect serial number, the result for the printer is inconvenience and delay, at the very least. It will often be an unacceptable hazard to permit incorrectly numbered documents to continue to exist. For this reason, it would be advantageous to monitor the rotational positions of the numbering wheels, and to arrange for the press to be operated under the control of data processing equipment which constantly monitors the correct operation of numbering wheels and interrupts the operation of the press in the event that there is a malfunction which leads to selection of incorrect indicia.

Manual resetting of a multiplicity of numbering boxes is very time-consuming. During the printing press revolution when a positional error on one numbering box is detected, only that specific box will require manual resetting after the press has been stopped. Should an additional printing press revolution be completed before the press has been stopped, then all of the numbering will have advanced one indicium past the required number and every box will then have to be manually reset after the press has been stopped. What is therefore needed is a response time so fast as to interrupt operation before the numbering boxes have advanced to the next successive indexing number.

As the numbering boxes are sited on a inking face of a printing element of the printing press, there will be a routine need for cleaning of the zone of the press where the numbering boxes are found. Cleaning the numbering boxes themselves is one example of a situation where the numbering wheels may require to be re-set to prescribed positions for a re-start of the printing operation of the press. Another example is of course the initialisation procedures which are carried out when a new print run is being set up on the press.

GB 2243580 A discloses means to monitor the position of each numbering wheel and to output to a central data processing means data indicative of the monitored positions of the wheels, so that the central processor can determine whether each of the numbering wheels of the press is in the correct desired position. Thus, the central processor can, for example, indicate which numbering box is faulty and what number should be present on the print face of the faulty numbering box.

A number of disadvantages of the technology described above have been recognized by the present inventor.

First, correct re-setting of the numbering box is dependent upon bringing into coincidence the numbers displayed on the print face of the numbering box in question with the numbers displayed on the output device of the central processor. It is a process of manual manipulation to bring the numbers of the numbering box at the print face into coincidence with the number called for by the central processor, in which the operator compares two sets of numbers. Human error cannot be excluded.

Second, the amount of data to be transmitted between the numbering box and the central processor is fairly substantial and this is inherently unattractive. Because normal printing cylinders contain a large number of printing boxes, a correspondingly large amount of data has to be extracted from the rotating printing cylinder for delivery to the central processor. The possibility that electronic data is corrupted in transit has also to be recognized, because the environment of a printing press is relatively hostile to transmission of such data.

The present invention has been made with these problems in mind and with a view to providing viable solutions to the problems.

According to a first aspect of the present invention there is provided a device for printing a distinctive and different index code on each successive one of a succession of value documents, the device comprising:

1. a plurality of print elements, mounted for movement to bring a selected one of a plurality of print indicia, present around a locus disposed on a peripheral surface of the print element, into registry with a print face of the device;
2. means for monitoring the position of the print indicia relative to the print face; and
3. indicating means corresponding to each print element, for providing a visual indication adjacent the print element of any discrepancy between the monitored position of the print element and a desired position thereof.

Normally, the printing device is a numbering box as discussed above, and each of the print elements is a numbering wheel, these wheels being arranged in a coaxial stack for rotation to bring indicia arranged around the cylindrical surface of the wheel into registry with the print face of the numbering box.

According to a second aspect of the present invention there is provided a numbering box for installation at a point on the print face of a printing press element, and removable therefrom for such purposes as cleaning and maintenance of the numbering box or press element, the numbering box comprising:

1. a plurality of print elements mounted for movement to bring a selected one of a plurality of print indicia present around a locus disposed on a peripheral surface of the print element into registry with a print face of the numbering box;
2. means for monitoring the position of the print indicia relative to the print face; and
3. data processing means carried on the numbering box for a) executing a program which prescribes successive print element positions b) comparing the monitored positions of each print element with the positions for that element prescribed by the program, and c) outputting from the numbering box any fault condition indicated by a discrepancy between the monitored and prescribed positions.

As with the first aspect, the print elements will normally be wheels (so-called numbering wheels).

Providing the data processing means in the numbering box makes possible a simplified data link between the numbering box and any central processor of the printing press. Indeed, the present applicant uses a single optical fiber data link which permits flow of data both into the numbering box and out of it. The printing press element would normally be a printing cylinder, so that the question has to be addressed how to abstract data from the rotating printing cylinder, for transmission to any central data processing facility. However, a rotary joint for an optical fiber, between a rotating and stationary element, is known per se and such a connection is used by Applicant to put the invention into effect. A further advantage accruing from the use of an optical fiber link is that the data travelling along the link cannot be corrupted by the electrical or magnetic aspects of the printing press environment which are liable to corrupt electrical data signals. Normally the optical fibre link between the printing cylinder and the stationary parts of the press is connected to any particular numbering box through an optical/electrical transducer and a signal amplifier.

By placing data processing capacity within the numbering box, in accordance with the second aspect of the present invention, another very important advantage is achieved, as follows:

The majority of production losses on a numbering press are the result of numbering box malfunctions, the majority of which are in consequence of a failure to carry out preventative maintenance programs at the proper intervals. The micro processor capacity of each individual numbering box can be employed to alert the press operator to the need for preventative maintenance of the numbering box in question. In preferred embodiments of the invention, the numbering box (and its associated electronics package) is assigned a unique identity, or serial number. This identity is retained in memory within the numbering box even when it is removed from the press for maintenance purposes. It is preferably a further function of the box microprocessor that the box registers, in its memory, the total quantity of indexing operations already undertaken by the box, and limits the quantity or batch size of further indexing operations.

This data can be down-loaded, either on-press or during maintenance, for input into a computer-based maintenance prompt and record system. Upon completion of a maintenance routine on an individual box, the system computer inputs "next service interval" data to the box. The data processor on the numbering box in question subsequently signals to the press operator, through the system VDU, when this interval is about to expire so that suitable action may be taken.

One way of providing the data processing capacity in the numbering box, in an attractive combination with the monitoring means, is to install a stack of circuit boards which are in one-to-one correspondence and facing relationship with the stack of numbering wheels. Numbering wheel position sensors are present on the edge of each such sensor board, where the edge faces the wheel in question. The opposite faces of the sensor boards are bonded to a mother board perpendicular to them, so that the individual sensor boards resemble the teeth of a comb and the mother board resembles the back of the comb. Additional computing and logic components are mounted on the mother board.

There is a difficulty with such an arrangement, however. It is possible to make very narrow (as little as 2.5 mm for example) the spacing between the numbering wheels of a stack in a numbering box, and there may be requirements for ever-smaller numbering wheel spacings. It is difficult to reduce the thickness of a printed circuit board and the circuit elements which it carries, down to a dimension which is as narrow as the slimmest numbering wheels. It is a further object of the present invention to find a way of reducing the pitch of the stack of sensor boards to meet such requirements.

Thus, in a third aspect, the present invention provides a numbering box which comprises:

1. a coaxial stack of numbering wheels each bearing a plurality of indicia spaced around the circumference of the wheel;
2. means for sensing the rotational position of each said wheel; and
3. a stack of component-carrying printed circuit boards for processing sensed rotational position data to determine a condition (for example, a fault condition) of any said numbering wheel; and characterized in that:

at least some of the printed circuit boards in the stack contain at least one through aperture to accommodate a circuit component which is bulky in the thickness direction of the circuit boards of the stack.

Normally, each such through aperture would contain at least one integrated circuit of that circuit board which contains the aperture. However, it is contemplated that at least some of the said through apertures might be used to accommodate one or other thick circuit element of a circuit carried on a circuit board adjacent to the one with the aperture in the circuit board stack.

In a particularly attractive embodiment of the invention, all three of its aspects are incorporated together. The numbering box has a stack of sensor boards in one to one correspondence with the stack of numbering wheels, and each of the boards has an edge on the print face of the numbering box. That edge carries a light emitting device (LED) which can be switched on and off by the logic circuitry and is used to provide a visual indication of a discrepancy between the monitored position of the corresponding print element and a desired position thereof. Another edge of the said sensor board is bonded to a mother board, the mother board and sensor board being perpendicular to each other. Yet a third edge of each sensor board carries the aforesaid monitoring means to keep track of the rotational position of the corresponding numbering wheel.

In one preferred embodiment these sensors are sensitive to magnetic fields (they might, for example, utilize the Hall effect) and the associated numbering wheel carries means (for example, small permanent magnets) to generate a magnetic field which varies at the location of the sensors as the print element moves.

Thus, visible on the print face of the numbering box are not only the indicia presented for printing but also a line of light emitting devices, one corresponding to each of the selected indicia, which can be used for indicating whether the indicium selected on any particular print element is the desired one, or not. For example, it can be arranged that the light emitting devices emit light only when the associated print element is in a position other than a desired position. Thus, it would for example be a relatively simple operation, when the press requires to be set up with an initial set of numbers of the numbering boxes, or when the central processor indicates a fault in the operation of a printing press, for a press operator to scan the print faces of the various numbering boxes to locate signalling devices emitting light. He needs then only rotate the print element corresponding to that lit-up signalling device, until the print element reaches a position which extinguishes the emission of light from the signalling element. From this he knows that the faulty position has been corrected. This is of course a task considerably simpler for the press operator than interrogate the central processor to identify the correct number to be displayed by any print element, and then manipulate the print element until its position corresponds to one displayed by the processor at a location remote from the numbering box.

For a better understanding of the invention, and to show more clearly how the same may be carried into effect, reference will now be made, by way of example, to the accompanying drawings, in which.

Figure 1:
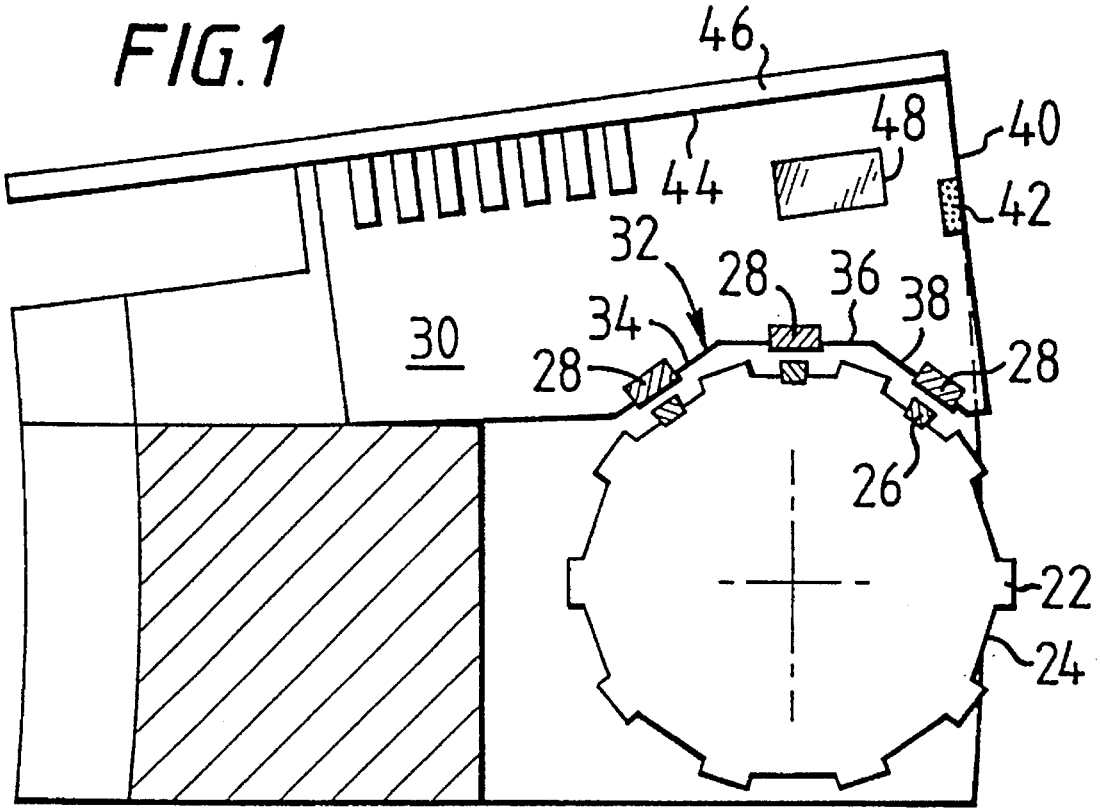
FIG. 1 is a section through one of the sensor boards of a numbering box in accordance with the invention.

The illustrated numbering box has a frame 10 which carries a stack of ten numbering wheels 11 to 20. The numbering wheel shown in FIG. 1 is representative of any one of the numbering wheels in the stack. Referring to FIG. 1, each numbering wheel has ten print faces 22 distributed at regular intervals around its circumference. Between any two adjacent print faces 22 there is a recess 24 and a small permanent magnet 26 is installed in each of selected ones of the recesses 24 and interface with three Hall effect magnetic sensors 28 which are edge-mounted on a sensor board 30.

Each recess can in this way be labelled "North", "South" or "zero" magnetic field. With these three possible indentities for each recess a total of 27 different stopping locations can be provided around any one wheel, each being uniquely identified by the three sensors together.

The print wheel and sensor board 30 are co-planar and the edge 32 of the board 30 which carries the three sensors 28 is in the shape of a cut-out bay to accommodate one of the step units of the print wheel in each of the three faces 34, 36 and 38 of the bay 32. As can be seen in FIG. 1, the sensor 28 on each face of the bay 32 addresses a succeeding one of the intervals between successive print faces 22 of the print wheel.

Figure 2:
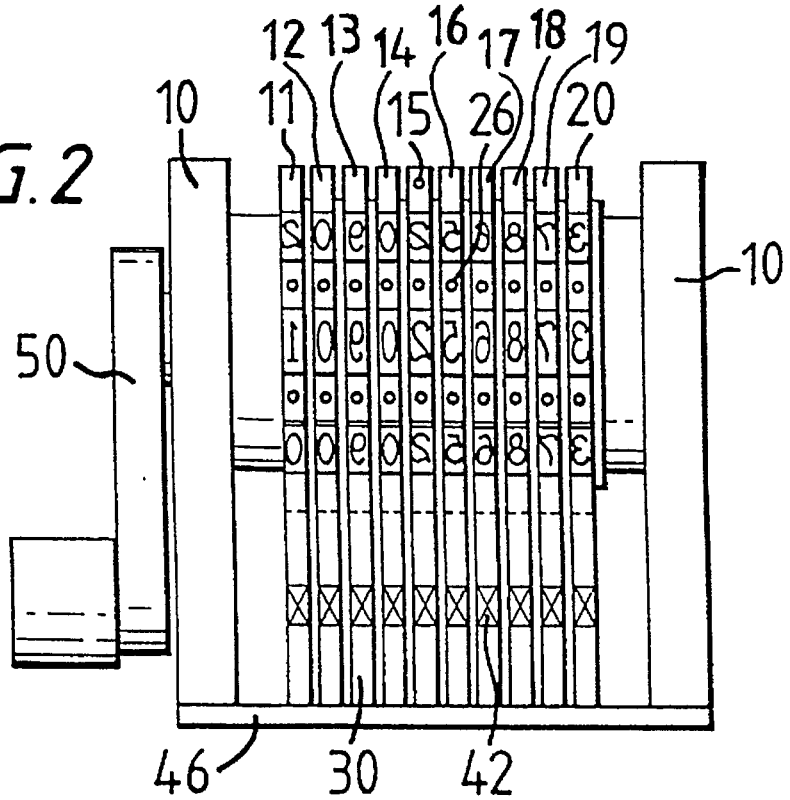
FIG. 2 is a view on the printing face of the numbering box.

Another edge 40 of the sensor board lies in the print face of the numbering box and contains an LED 42. In this way, each numbering wheel is associated with an individual LED on the respective sensor board 30. FIG. 2 shows the print face with all of the numbering wheels 11 to 20 and all ten of the LED's 42, one for each of the numbering wheels.

On yet a third edge 44 of each sensor board 30 is bonded a mother board 46 which contains data processing logic which works with the circuitry on each of the sensor boards 30. Further details of this circuitry are given below by reference to FIG. 3 of the drawings.

The sensor boards 30 form a stack and the spacing between boards is small, so that each board may face a respective numbering wheel. Each board 30 has an aperture 48 in which is received any components on an adjacent board which are thicker than the available spacing between the boards.

The numbering wheels 11 to 20 of the numbering box are advanced in a way which is conventional and in itself forms no part of the present invention. Thus, referring to FIG. 2, there is a conventional wheel indexing lever 50 which is cranked once for each printing imprint of the numbering box, this cranking movement being delivered along the axis of the stack of numbering wheels 11 to 20 to cause the prescribed advancing movement of at least one of the wheels.

Figure 3:
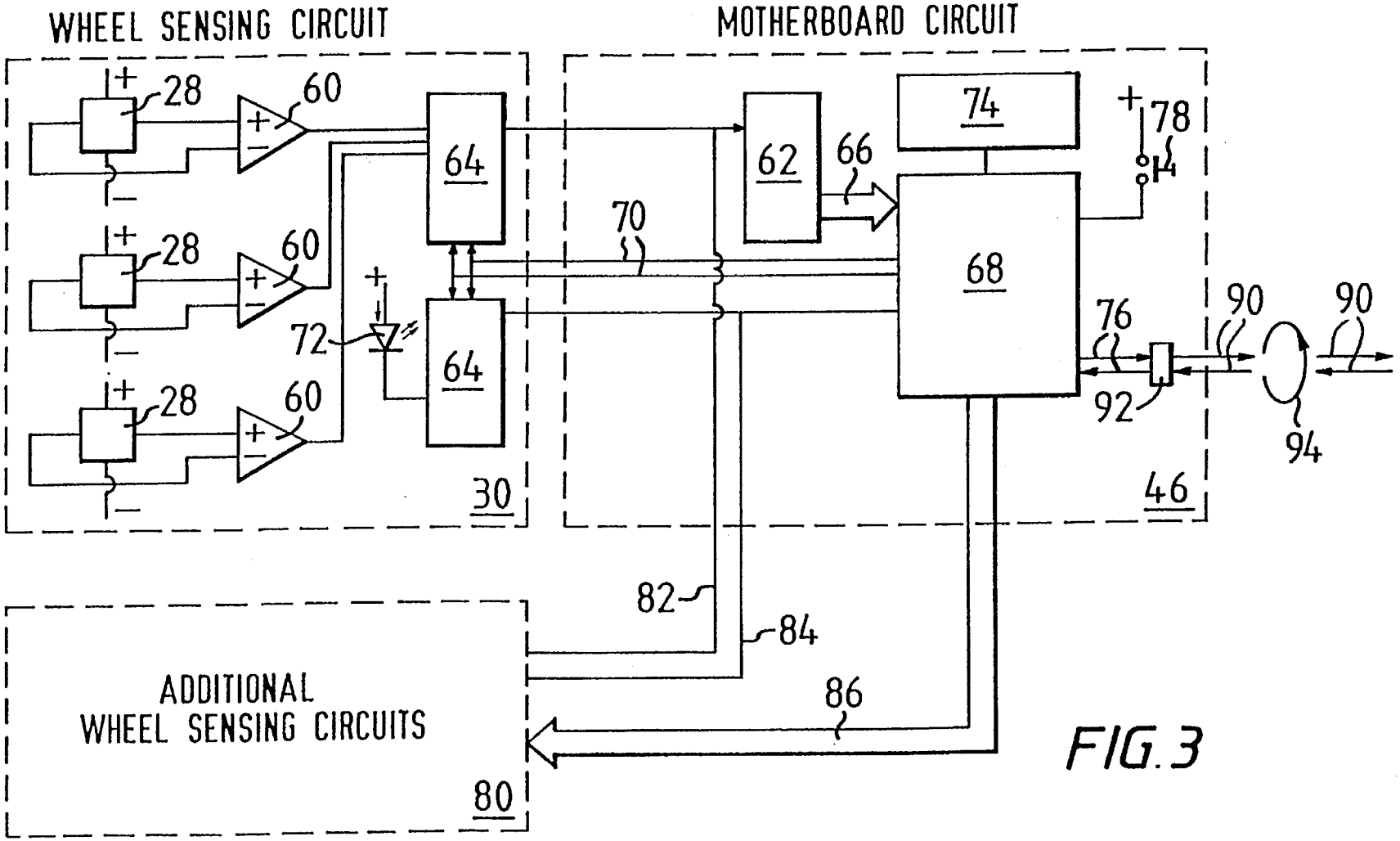
FIG. 3 is a schematic circuit diagram of the logic in the numbering box.

Turning now to FIG. 3 of the drawings, each Hall effect magnetic sensor 28 delivers its output to a differential amplifier 60 and the individual outputs from these amplifiers are passed to an analog to digital converter 62 on the mother board through a multiplexing circuit 64 on the sensor board. The digital output 66 of the converter is inputted to a microprocessor 68 which employs digital thresholding of the analog signals to confine the print wheel rotation angles over which a valid code is observed.

The microprocessor 68 and converter 62 can operate at many times the rate at which the code signals from the printing wheel are generated. Accordingly, a large plurality of wheel sensing circuits can be multiplexed into the mother board circuitry.

The microprocessor 68 outputs control signals 70 which govern the operation of the multiplexing circuits 64. They also control the operation of any required additional elements including an LED 72 which provides a visual signal to the user regarding the status of the print wheel position. For instance, if the print wheel is correctly positioned it can be arranged that the microprocessor maintains the LED in an off condition. If the wheel is in a printing disposition but at the wrong printing facet, the microprocessor arranges for the LED to flash rapidly on and off. If the print wheel is not at a printing disposition at all, to the extent that none of the print facets lies fully in the printing plane, the microprocessor arranges for the LED to be continuously lit. The LED 72 can be used, with appropriate programming, to convey other messages by the use of different flashing patterns and frequencies.

Additional support circuitry 74 provided to the microprocessor 68 includes such features as a clock signal, and non-volatile random access memory (R.A.M.) for personalizing the numbering box with individual features such as its unique identity, the type of printing device that it is, and the calculation sequence it is required to perform during normal operation. In this way, devices produced in quantity to be identical and containing identical software can be programmed to perform individually.

The microprocessor 68 is connected to a central computer (normally a personal computer) by control lines 76. It is contemplated to use a single strand fibre optic cable for essentially all transmissions of data between the numbering box and the central computer.

A push button 78 is provided for signalling to the associated microprocessor 68 that a numbering box identity code being transmitted to all numbering boxes on any common data network which includes control lines 76 is in fact intended for it.

Additional wheel sensing circuits 80, each on an individual sensor board, one for each of the other numbering wheels of the numbering box, are each connected to the microprocessor 68 through an input data line 82, an output signal line 84 and control lines 86.

In use, the numbering box is assembled and the microprocessor is programmed and many such numbering boxes installed in the printing press. One by one the installed boxes are given their individual identity codes by transmitting all the codes from the central computer, one by one, to the individual numbering boxes. Push button 78 of each particular numbering box is used to associate that box with the identity code being transmitted by the central computer at that time.

The LED's are used to signal actuation of the box address button 78, a suitably distinct LED signal cycle being two flashes followed by a pause.

As soon as the numbering box has received its specific identity code it is able to compare the actual position of each of its numbering wheels with that prescribed for press operation and signal at the appropriate LED 42 when a wheel position is faulty. Thus, all the wheels 11 to 20 are rotated manually until none of the LED's is illuminated, this signalling that all wheels are correctly positioned.

The RAM in the numbering box retains data while a numbering box is removed from the press for cleaning, repair or maintenance. On re-assembly and re-installation in the press, the numbering wheels are manually rotated once more until all LED's are extinguished.

Data transmission between -the numbering box and the off-press computer whilst the press is rotating is confined to error signals and handshake signals. In this way, it is possible to simplify and speed communications. Input and output data can both be transmitted by a single fibre-optic cable connected to the motherboard components through an electrical/optical transducer 92 on the motherboard and an optical/rotational link 94 between the press cylinder on which the numbering box is carried and the surrounding non-rotational structure of the printing press.

What we claim is:

1. A device for printing a distinctive and different index code on each successive one of a succession of documents, the device comprising:

a plurality of print elements, mounted for movement to bring a selected one of a plurality of print indicia present around a locus disposed on a peripheral surface of each of the print elements, into registry with a print face of the device;

a support structure;

means for monitoring the position of the print indicia relative to the print face, said means for monitoring depending from the support structure; and indicating means depending from the support structure and corresponding to each of the print elements, for providing a visual indication adjacent each of the print elements of any discrepancy between the monitored position of each of the print elements and a desired position thereof.

2. A printing device as claimed in claim 1 wherein each print element is a numbering wheel.

3. A printing device as claimed in claim 1 wherein the monitoring means are magnetic and rely on the Hall effect.

4. A printing device as claimed in claim 1 wherein the device includes data processing means arranged to output to the indicating means and to receive as input signals from the monitoring means.

5. A printing device as claimed in claim 1 including an optical/electrical transducer to connect the device to an optical fibre for communication with a remote data processor.

6. A printing device as claimed in claim 5 including an optical fibre rotary joint to enable the device to be mounted on a rotatory component of a printing press and communicate with an off-press data processing means.

7. A numbering box for installation at a point on the print face of a printing press element, and removable therefrom for such purposes as cleaning and maintenance of the numbering box or press element, the numbering box comprising:

a housing detachably mounted to the print face of a printing press element;

a plurality of print elements mounted within the housing for movement to bring a selected one of a plurality of print indicia present around a locus disposed on a peripheral surface of each of the print elements into registry with a print face of the numbering box;

means for monitoring the position of the print indicia relative to the print face, said means for monitoring depending from the housing; and data processing means carried on the numbering box for a) executing a program which prescribes successive print element positions b) comparing the monitored positions of each print element with the positions for that element prescribed by the program, and c) outputting from the numbering box any fault condition indicated by a discrepancy between the monitored and prescribed positions.

8. A numbering box as claimed in claim 7 including indicating means adjacent the print elements and actuated by the data processing means.

9. A numbering box as claimed in claim 7 in which the print elements are numbering wheels.

10. A numbering box as claimed in claim 9 wherein each print element carries permanent magnet means and the monitoring means uses a Hall effect sensor to detect said permanent magnet means.

11. A numbering box as claimed in claim 7 including an optical/electrical transducer to connect the device to an optical fiber for communication with a remote data processor.

12. A numbering box as claimed in claim 11 including an optical fibre rotary joint to enable the device to be mounted on a rotatory component of a printing press and communicate with an off-press data processing means.

13. A numbering box which comprises a coaxial stack of numbering wheels each bearing a plurality of indicia spaced around the circumference of each of the wheels;

means for sensing the rotational position of each of the wheels;

indicating means on a print face of the box for indicating a discrepancy between a monitored and a desired position of a print element; and a stack of component-carrying printed circuit boards for processing sensed rotational position data to determine a condition of any of the numbering wheels;

at least some of the printed circuit boards in the stack containing at least one through aperture to accommodate a circuit component which is bulky in the thickness direction of the circuit boards of the stack.

* * * * *